US008070442B1

(12) United States Patent
Liang

(10) Patent No.: US 8,070,442 B1
(45) Date of Patent: Dec. 6, 2011

(54) TURBINE AIRFOIL WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 668 days.

(21) Appl. No.: 12/242,979

(22) Filed: Oct. 1, 2008

(51) Int. Cl.
*F01D 5/08* (2006.01)
*F01D 5/18* (2006.01)

(52) U.S. Cl. ..... 416/97 R; 416/226; 416/96 R

(58) Field of Classification Search ..... 416/96 R, 416/97 R, 224, 226; 415/115
See application file for complete search history.

(56) References Cited

U.S. PATENT DOCUMENTS 6,183,198 B1 * 2/2001 Manning et al. ..... 416/97 R
7,097,426 B2 * 8/2006 Lee et al. ..... 416/97 R
7,690,892 B1 * 4/2010 Liang ..... 416/1
2006/0056967 A1 * 3/2006 Liang ..... 416/97 R
2007/0128034 A1 * 6/2007 Lee et al. ..... 416/97 R

* cited by examiner

*Primary Examiner* — Kiesha Bryant
*Assistant Examiner* — Abbigale Boyle
(74) *Attorney, Agent, or Firm* — John Ryznic

(57) ABSTRACT

An turbine airfoil and a process for near wall cooling of a turbine airflow with low flow in which the airfoil is formed by a main spar that forms the support structure for the airfoil and forms a series of cooling air collecting chambers extending from the leading edge region to the trailing edge region of the airfoil. A thermal skin forms an outer airfoil surface and also forms a series of pressure side and suction side impingement chambers along the airfoil walls. A cooling air supply chamber is formed by the spar in the leading edge region and supplies the cooling air for the airfoil. A series of leading edge impingement chambers are formed along the leading edge and carry the cooling air from the supply chamber to the series of collection chambers and impingement chambers downstream. The spent cooling air is then collected in a trailing edge collecting chamber and discharged through a row of exit holes.

19 Claims, 4 Drawing Sheets

TURBINE AIRFOIL WITH NEAR WALL COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine airfoil with relatively low cooling flow volume.

2. Description of the Related Art including information disclosed under 37 CFR 1.97 and 1.98

In a gas turbine engine, airfoils such as stator vanes (sometimes referred to as guide nozzles) and rotor blades are exposed to extremely high temperature gas flows in order to produce a high efficient conversion of the combustion gas. In order to allow for higher temperature, the airfoils exposed to the higher temperatures require internal and external cooling. Elaborate internal cooling circuits have been designed to produce convection cooling for the airfoils, and film cooling holes are used to provide a layer of film cooling air over certain external surfaces of the airfoil to limit exposure to the hot gas flow. An airfoil with many film cooling holes requires a larger volume of cooling air flow because much of the cooling air is discharged out from the airfoil before passing through much of the airfoil internal cooling circuit.

In future industrial gas turbine engines, large airfoils are proposed in which the latter stages will also require some sort of internal cooling in order to increase the useful life of the airfoils. In recent engines, typically only the first and second stages of the turbine require internal cooling while the last two stages (third and fourth) are not cooled at all.

BRIEF SUMMARY OF THE INVENTION

It is an object of the present invention to provide for a turbine airfoil with a high level of cooling while using a low amount of cooling air.

It is another object of the present invention to provide for a turbine airfoil with near wall cooling.

It is another object of the present invention to provide for a turbine airfoil with an internal cooling circuit that can be tailored to the external airfoil heat load on individual sections of the airfoil.

A turbine airfoil, such as a stator vane or a rotor blade, used in a gas turbine engine, the airfoil having a main support spar extending from the root and platform section that has a general airfoil cross sectional shape and forms a main cooling air supply chamber near the leading edge and a series of alternating cooling air impingement chambers and cooling air collecting chambers extending along the airfoil to the trailing edge region. A thin thermal skin is bonded to the outside surface of the spar to form the airfoil outer surface and to define a plurality of impingement chambers formed between the spar and the thermal skin. Cooling air supplied to the cooling air supply chamber flows through impingement holes into a series of impinge cut chambers spaced along the leading edge region and into a cooling air collector chamber, and then through impingement holes into an impingement chamber on the suction side wall. This series of impingement cooling followed by collector chamber cooling is repeated in an alternating process from the pressure side wall to the suction side wall until the cooling air is discharged into a trailing edge region collector chamber, where the cooling air is then discharged out through trailing edge exit holes. In another embodiment, one or more rows of film cooling holes can be connected to selected ones of the collector chambers to discharge some of the cooling air through film holes to provide a layer of film cooling air onto the external airfoil surface.

DETAILED DESCRIPTION OF THE INVENTION

Figure 1:
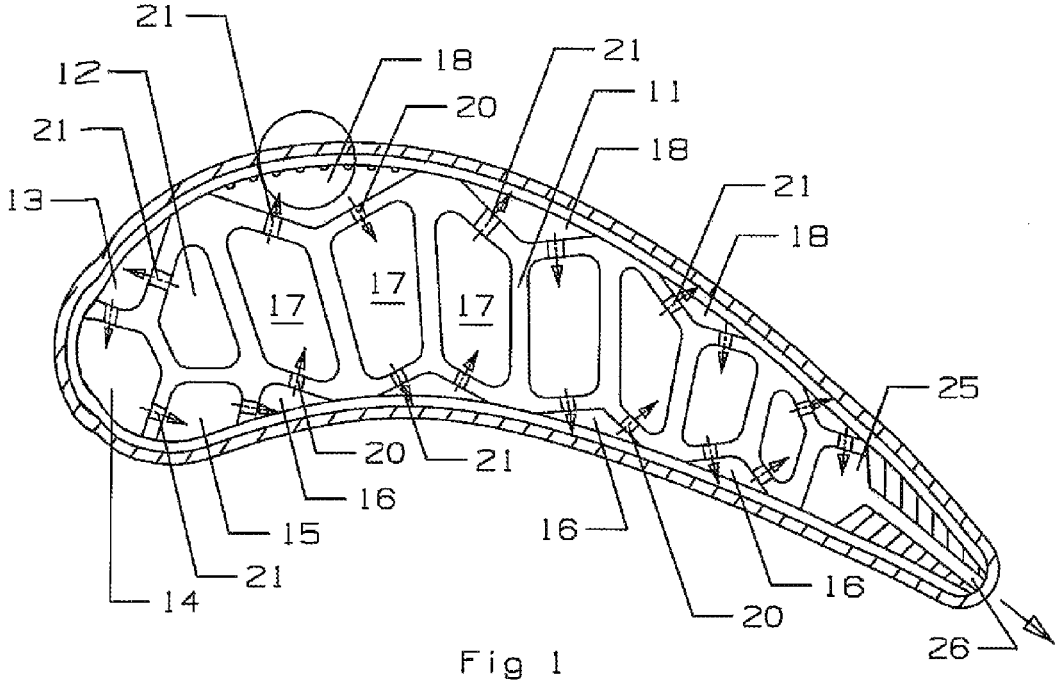
FIG. 1 shows a cross section view of the near wall cooling circuit of the present invention.

The low flow near wall cooling circuit of the present invention is disclosed for use in a turbine blade. However, the cooling circuit of the present invention can also be used in a stator vane. FIG. 1 shows a cross section view of the airfoil with the low flow near wall cooling circuit that include a main spar 11 that provides support for the blade and extends from the root. The main spar and root can be cast as a single piece or the spar can be secured to the root to form an integral piece. The main spar is formed of a number of ribs extending from the pressure side to the suction side of the airfoil to form collector chamber 17, and a number of slanted outer walls that define pressure side impingement chambers 16 and suction side impingement chambers 18. The main spar 11 also forms a cooling air supply chamber 12 and four impingement chambers 13-15 that extend along the leading edge of the airfoil.

Figure 2:
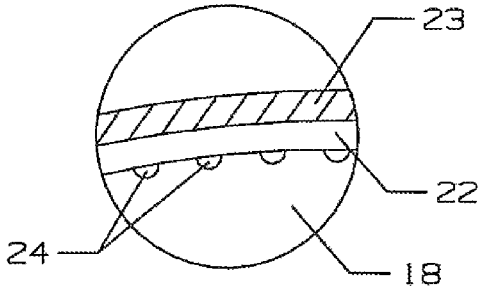
FIG. 2 shows a detailed view of the thin thermal skin with micro pin fins on the inner surface used in the airfoil of the present invention.
Figure 3:
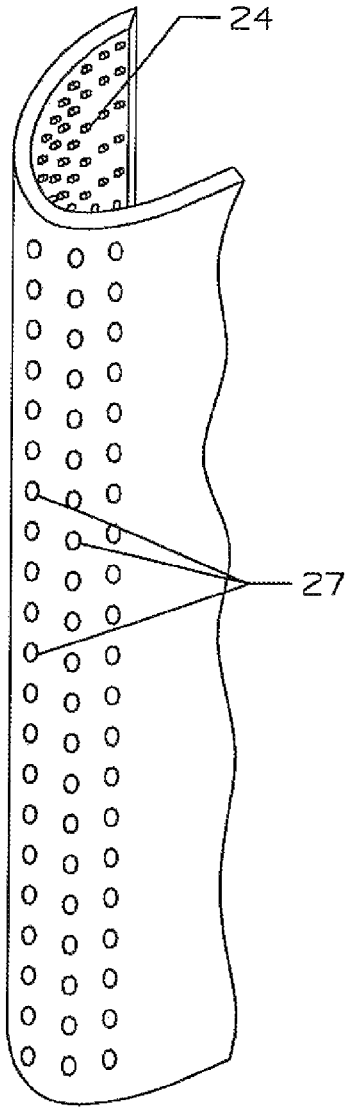
FIG. 3 shows a isometric view of the inner and outer surfaces of the thermal skin in the leading edge region of the airfoil of FIG. 1.
Figure 4:
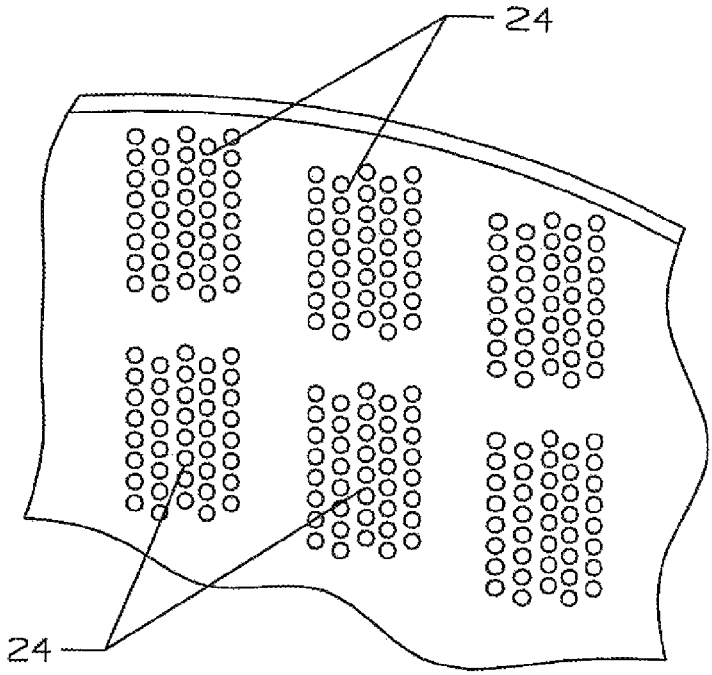
FIG. 4 shows the backside surface of the thermal skin with the pattern of micro pin fins.

A thin thermal skin 22 is bonded to the outer surface of the spar to form the outer airfoil surface. The thermal skin can be bonded to the spar using a transient liquid phase (TLP) bonding process. A thermal barrier coating (TBC) 23 is applied over the thermal skin 22. FIG. 2 shows a detailed view of the thermal skin 22 and TBC 23 with a number of micro pin fins 24 fanned along the inner surface of the thermal skin 22. The thermal skin 22 and the spar 11 form the leading edge impingement chambers 13-15 and the pressure side and suction side impingement chambers 16 and 18 that extend along the airfoil walls as seen in FIG. 1. The thin thermal skin includes micro pin fins arranged along the inner surface as shown in FIGS. 3 and 4 to enhance the impingement cooling of the cooling air discharged from the impingement holes 18 in the spar 11. The thin thermal skin has a thickness in the range of 0.010 inches to 0.030 inches and the micro pin fins have a diameter and a height of about the same order as the thermal skin thickness. The density of the micro pin fins 24 can be in the range of 50 to 75 percent.

The collector chambers 17 are formed within the spar 11 and extend from the leading edge to the trailing edge of the airfoil. Impingement holes 21 formed in the main spar 11 connect the collector chambers with the impingement chambers 13-15 and 16 and 18. As seen in FIG. 1, the last leading edge impingement chamber 15 is connected to a pressure side impingement chamber 16 and the collector chamber 17 through impingement holes 21, which connects to a suction side impingement chamber 18 through impingement holes 21, and then into an adjacent collector chamber 17 through impingement holes 21. Spent cooling air from the impingement chambers 18 flow into the collection chambers 17 through return holes 20. This alternating repetition of collector chamber 17, then pressure side impingement chamber 16, then collector chamber 17, then suction side impingement chamber 18 repeats along the airfoil until the last collector chamber 25 position adjacent to the trailing edge of the airfoil. The last or trailing edge collector chamber 25 is connected to a row of trailing edge exit cooling holes that discharge the spent cooling air from the airfoil. Cooling holes that discharge cooling air for impingement against the airfoil wall are impingement holes 21 while the cooling holes that return spent cooling air into the collector chambers are return holes 20.

Figure 5:
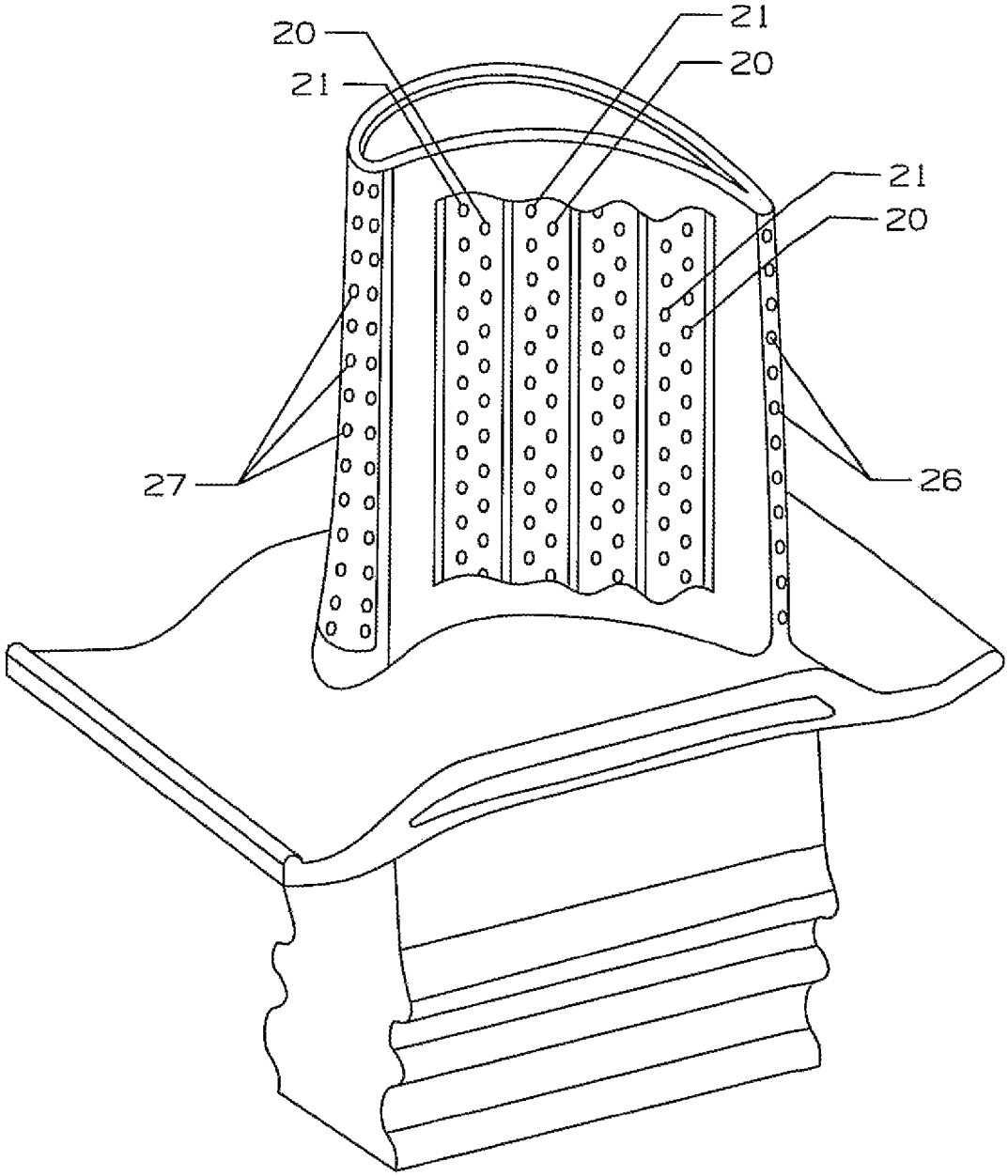
FIG. 5 shows an isometric view of a turbine blade with an opening to show several of the collector chambers with impingement holes arranged along the passage.

The pressure and suction side collector chambers 16 and 18 and leading edge collector chambers 13-15 extend along the airfoil from the root to the tip as seen in the opening of the blade in FIG. 5. The spar includes a row of impingement holes 21 and return holes 20 extending along the spar wall to provide impingement cooling along the length of the thermal skin and return holes for the spent impingement air that forms the particular collector chamber.

The operation of the low flow near wall cooling circuit in FIG. 1 is described below. Pressurized cooling air is supplied to the supply chamber 12 and flows into the first leading edge impingement chamber 13 through a row of impingement holes 21 to provide impingement cooling on the backside surface of the thermal skin 22 in that chamber. The cooling air then flows into the second leading edge impingement chamber 14 through another row of impingement holes 21 to provide impingement cooling to the backside surface of the thermal skin. This repeats through the third impingement chamber 15 to provide impingement cooling of the remaining section of the leading edge. This cooling air then flows into the first pressure side impingement chamber 16 and then into the first collector chamber 17 adjacent to the cooling air supply chamber 12 through a row of return holes 20.

From the first collector chamber 17, the cooling air flows into the first suction side impingement chamber 18 through a row of impingement holes 21 to provide impingement cooling to the backside surface of the thermal skin. From the first suction side impingement chamber 18, the cooling air flows into the next collector chamber 17 through the return holes 20 and then into the second pressure side impingement chamber 16 through a row of impingement holes 21 to provide impingement cooling to the backside surface of the thermal skin 22 of the pressure side wall. This cooling air flow—from pressure side impingement chamber 16 into a collector chamber 17 and then into the suction side impingement chamber 18—is repeated until the cooling air flows through a row of return holes 20 and into the last or trailing edge collector chamber 25. From here the spent cooling air flows through a row of exit holes 26 along the trailing edge and out from the airfoil. In the embodiment of FIG. 1, all of the cooling air supplied to the cooling air supply chamber 12 flows through the airfoil cooling circuit and then eventually out through the exit cooling holes 26 along the trailing edge. Thus, near wall cooling of the entire airfoil surface is performed with a low volume of cooling air since none of the cooling air is discharged through film holes before reaching the exit cooling holes.

Also, the cooling air supplied to the cooling air supply chamber 12 first flows through impingement chambers that extend along the leading edge region of the airfoil where the heat load is the highest. Thus, the relatively cool cooling an is first used to provide cooling to the hottest section. The micro pin fins on the backside surface of the thin thermal skin in each of the impingement chambers increase the heat transfer rate. In the first embodiment of FIG. 1, a number of rows of film cooling holes can be used to form a showerhead arrangement that connect to the leading edge impingement chambers 13-16 and discharge a layer of film cooling air can be used if warranted.

Figure 6:
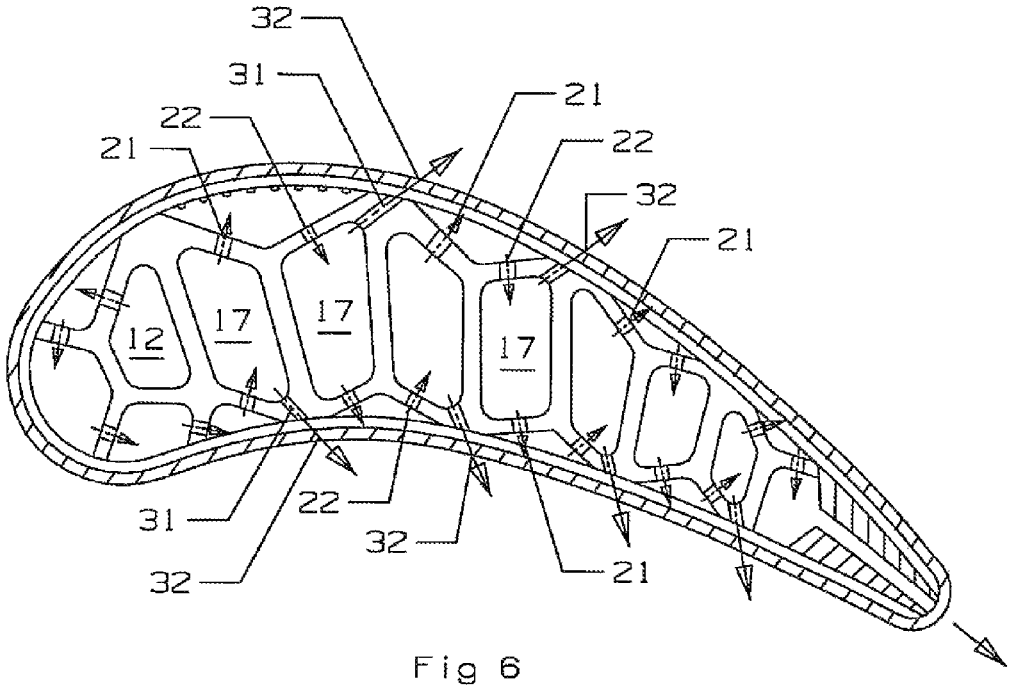
FIG. 6 shows a second embodiment of the near wall cooling circuit of the present invention with film cooling holes.

FIG. 6 shows a second embodiment of the near wall cooling circuit of the present invention where some of the collector chambers 17 include a row of film cooling holes 31 that open onto the airfoil surface as film cooling holes 32. As seen in FIG. 6, the first collector chamber discharges film cooling air onto the pressure side wall and the next adjacent collector chamber discharges film cooling air onto the suction side wall. This repeats for the next three collector chambers. The number of collector chambers with film cooling holes and the location of the film cooling holes will depend on the location required for film cooling of the airfoil outer surfaces. In the FIG. 6 embodiment, some of the cooling an collected in the collector chamber 17 will flow out through the film holes 32 while the remaining cooling air flows into the next impingement chamber 17.

In either embodiment above, the main spar can be cast and the impingement holes and the film holes (if used) can be drilled into the spar after the casting process. The thin thermal skin 22 can then be bonded to the spar and the TBC applied over the surface. The film holes can be drilled after the TBC is applied of the film holes can be covered while the TBC is applied and then uncovered to leave the holes open on the TBC surface.

The impingement holes 21 of each of the collector and impingement chambers can be sized to regulate the amount of impingement cooling produced depending upon the temperature and pressure profile of the airfoil. Also, the use of total cooling for repeating impingement cooling process generates extremely high turbulence for a fixed amount of coolant flow and therefore creates a high value of internal heat transfer coefficient. This yields a higher internal convection cooling effectiveness than the prior art single pass impingement cooling design. The end result of the low flow near wall cooling design of the present invention is to achieve a balance between a longer airfoil life and a reduced cooling flow amount.

Instead of the micro pin fins on the backside surface of the thermal skin, concaved shaped dimples can be used. The thermal skin can be a different material than the spar or can be the same material. also, the thermal skin can be one piece that extends around the leading edge on both sides of the airfoil ending at the trailing edge, or can be formed from multiple pieces all bonded to the spar. The thermal skin can be a high temperature resistant material in a thin sheet form in order to produce very high levels of near wall cooling. The micro pin fins 24 can be formed by photo etching or chemical etching onto the backside of the thermal skin. A low conductivity TBC material can be used on the thermal skin external surface to provide further reduction of the heat flux onto the airfoil external wall.

I claim the following:

1. A turbine airfoil comprising:

a main spar extending along the entire airfoil surface;

the main spar forming a main support for the airfoil;

a thermal skin bonded to the main spar to form an outer airfoil surface;

the main spar forming a cooling air supply chamber adjacent to a leading edge region of the airfoil;

the main spar forming a series of collector chambers extending along the airfoil from the cooling air supply chamber to the trailing edge region of the airfoil;

a series of impingement chambers formed in the leading edge region of the airfoil and connected to the cooling air supply chamber by a row of impingement holes;

a suction side impingement chamber formed between the main spar and the thermal skin;

a pressure side impingement chamber formed between the main spar and the thermal skin; and, impingement holes formed within the main spar to connect the series of leading edge impingement chambers and the suction side impingement chamber and the pressure side impingement chamber such that the cooling air supplied to the cooling air supply chamber flows through the series of leading edge impingement chambers, one of the collector chambers, the suction side impingement chamber, a collector chamber adjacent to the cooling air supply chamber, and then into the pressure side impingement chamber to provide impingement cooling to the backside of the thermal skin in each of the chambers in series.

2. The turbine airfoil of claim 1, and further comprising:

the series of leading edge impingement chambers are formed of a suction side leading edge impingement chamber, a leading edge impingement chamber and a pressure side impingement chamber connected in series with the suction side impingement chamber connected to the cooling air supply chamber and the pressure side impingement chamber connected to the first collector chamber adjacent to the cooling air supply chamber.

3. The turbine airfoil of claim 2, and further comprising:

the suction side impingement chamber is connected to the first and second collector chambers through a row of impingement holes and a row of return holes; and, the pressure side impingement chamber is connected to the second and a third collector chambers through a row of impingement holes and a row of return holes.

4. The turbine airfoil of claim 1, and further comprising:

the thermal skin is a thin thermal skin to provide near wall cooling from the impingement cooling air.

5. The turbine airfoil of claim 1, and further comprising:

a trailing edge collector chamber formed within the spar and adjacent to the trailing edge region of the airfoil; and, a row of exit cooling holes connected to the trailing edge collector chamber.

6. The turbine airfoil of claim 1, and further comprising:

the spar and the thermal skin forming a plurality of pressure side impingement chambers and suction side impingement chambers and collector chambers each connected by a row of impingement holes such that the cooling air discharged from the leading edge impingement chambers flows in series through a collector chamber, a suction side collector chamber, then an adjacent collector chamber, then a pressure side collector chamber, then an adjacent collector chamber, then into a suction side collector chamber through impingement holes to provide impingement cooling to the backside surface of the thermal skin along the airfoil wall.

7. The turbine airfoil of claim 6, and further comprising:

the leading edge impingement chambers are connected to a showerhead arrangement of film cooling holes to provide film cooling for the leading edge.

8. The turbine airfoil of claim 7, and further comprising:

no film cooling holes are used on the remaining surface of the airfoil so that all of the cooling air supplied from the cooling air supply chamber that is not discharged out through the showerhead film holes flows out through exit cooling holes along the trailing edge of the airfoil.

9. The turbine airfoil of claim 7, and further comprising:

a row of pressure side film cooling holes connected to one of the collector chambers to discharge film cooling air onto the pressure side wall; and, a row of suction side film cooling holes connected to another of the collector chambers to discharge film cooling air onto the suction side wall.

10. The turbine airfoil of claim 4, and further comprising:

the thin thermal skin includes a plurality of micro pin fins formed on the backside surface in the impingement chambers.

11. The turbine airfoil of claim 1, and further comprising:

a TBC applied over the thermal skin.

12. A process for near wall cooling of a turbine airfoil comprising the steps of:

supplying pressurized cooling air to a cooling air supply channel formed in the airfoil near a leading edge region;

cooling the leading edge of the airfoil with a series of impingement holes with cooling air from the cooling air supply channel;

collecting the spent leading edge impingement cooling air into a collector chamber;

impinging the collected cooling air against the backside of the airfoil wall;

collecting the backside wall impinging cooling air into another collector chamber; and, impinging the collected cooling air against the backside of the airfoil wall on an opposite side from the earlier impinged backside cooling.

13. The process for near wall cooling of claim 12, and further comprising the step of:

impinging the backside surface of the airfoil wall against micro pin fins to enhance the heat transfer coefficient.

14. The process for near wall cooling of claim 12, and further comprising the step of:

collecting the cooling air and impinging the cooling air against the airfoil back wall surface in an alternating manner from the pressure side to the suction side toward the trailing edge of the airfoil.

15. The process for near wall cooling of claim 14, and further comprising the step of:

collecting the spent impingement cooling air in a trailing edge region of the airfoil; and then cooling the trailing edge region by discharging the cooling air through trailing edge exit holes.

16. The process for near wall cooling of claim 12, and further comprising the step of:

discharging a layer of film cooling air onto the leading edge surface from the leading edge impingement cooling air.

17. The process for near wall cooling of claim 12, and further comprising the step of:

discharging a layer of film cooling air onto the pressure side surface from one of the collector chambers.

18. An air cooled turbine airfoil comprising:

a main spar having a general shape of the airfoil with a leading edge region and a trailing edge region, and with a pressure side wall and a suction side wall both extending from the leading edge region to the trailing edge region;

a cooling air supply chamber formed by the main spar and adjacent to the leading edge region;

a plurality of collector chambers formed by the main spar;

a plurality of pressure side impingement chambers formed by the main spar;

a plurality of suction side impingement chambers formed by the main spar;

a leading edge impingement chamber;

a plurality of impingement holes connecting the cooling air supply chamber to the plurality of collection chambers and the pressure and suction side impingement chambers such that cooling air flows in series alternating from the pressure side impingement chambers to the suction side impingement chambers to provide impingement cooling for the airfoil; and, a thermal skin bonded to the main spar to form an outer airfoil surface and to enclose the plurality of pressure side and suction side impingement chambers.

19. The air cooled turbine airfoil of claim 18, and further comprising:

the leading edge region includes the leading edge impingement chamber and a leading edge suction side impingement chamber and a leading edge pressure side impingement chamber;

the leading edge suction side impingement chamber is connected directly to the cooling air supply chamber;

the leading edge impingement chamber is connected directly to the leading edge suction side impingement chamber; and, the leading edge pressure side impingement chamber is connected directly to the leading edge impingement chamber.

* * * * *